US009470456B2

(12) United States Patent
Aichinger et al.

(10) Patent No.: US 9,470,456 B2
(45) Date of Patent: Oct. 18, 2016

(54) METHOD AND DEVICE FOR CHARGING COAL-CONTAINING MATERIAL AND IRON CARRIER MATERIAL

(75) Inventors: Georg Aichinger, Asten (AT); Franz Berner, Asten (AT); Thomas Eder, Traun (AT); Robert Millner, Loosdorf (AT); Jan-Friedemann Plaul, Linz (AT); Norbert Rein, Vienna (AT); Andreas Scherney, Hoersching (AT); Kurt Wieder, Schwertberg (AT); Johann Wurm, Bad Zell (AT)

(73) Assignee: PRIMETALS TECHNOLOGIES AUSTRIA GmbH, Linz (AT)

( * ) Notice: Subject to any disclaimer, the term of this patent is extended or adjusted under 35 U.S.C. 154(b) by 203 days.

(21) Appl. No.: 14/118,849

(22) PCT Filed: May 9, 2012

(86) PCT No.: PCT/EP2012/058499

§ 371 (c)(1),
(2), (4) Date: Nov. 19, 2013

(87) PCT Pub. No.: WO2012/156243

PCT Pub. Date: Nov. 22, 2012

(65) Prior Publication Data

US 2014/0110891 A1 Apr. 24, 2014

(30) Foreign Application Priority Data

May 19, 2011 (AT) ..... A 723/2011

(51) Int. Cl.
*F27D 3/00* (2006.01)
*C21B 13/00* (2006.01)
(Continued)

(52) U.S. Cl.
CPC ..... *F27D 3/0025* (2013.01); *C21B 13/002* (2013.01); *C21B 13/0066* (2013.01);
(Continued)

(58) Field of Classification Search
CPC ..... F27D 3/0025; F27D 3/0026
USPC ..... 266/199
See application file for complete search history.

(56) References Cited

U.S. PATENT DOCUMENTS 4,412,858 A 11/1983 Viramontes-Brown et al.
4,898,366 A 2/1990 Vuletic
(Continued)

FOREIGN PATENT DOCUMENTS

AT A 723/2011 5/2011
CN 101855506 10/2010
(Continued)

OTHER PUBLICATIONS

English Abstract for Japanese Patent Publication 2011068926 A published Apr. 7, 2011.
(Continued)

*Primary Examiner* — Scott Kastler
(74) *Attorney, Agent, or Firm* — Staas & Halsey LLP

(57) ABSTRACT

A melter gasifier of a smelting reduction installation is charged by bringing together coal -containing material in lump form and iron carrier material (which may be hot) before and/or while they enter the melter gasifier. The ratio of the combined amounts of iron carrier material and coal-containing material in lump form is variable. The combined amounts of iron carrier material and coal-containing material in lump form are distributed over the cross section of the melter gasifier by a dynamic distributing device, and the ratio of the combined amounts of the iron carrier material and coal-containing material in lump form is set depending on the position of the dynamic distributing device.

18 Claims, 2 Drawing Sheets

(51) Int. Cl.

| | |
|---|---|
| ***C21B 13/14*** | (2006.01) |
| ***F27D 3/08*** | (2006.01) |
| ***F27D 19/00*** | (2006.01) |
| ***F27D 21/00*** | (2006.01) |

(52) U.S. Cl.
CPC ..... *C21B13/143* (2013.01); *F27D 3/0026* (2013.01); *F27D 3/08* (2013.01); *F27D 19/00* (2013.01); *F27D 21/0035* (2013.01)

(56) References Cited

U.S. PATENT DOCUMENTS

| | | | | |
|---|---|---|---|---|
| 4,913,406 | A * | 4/1990 | Fukushima | C21B 5/006 266/176 |
| 6,156,262 | A | 12/2000 | Zschetzsche | |
| 6,277,172 | B1 | 8/2001 | Kepplinger et al. | |
| 8,313,552 | B2 | 11/2012 | Kepplinger | |
| 2008/0008563 | A1* | 1/2008 | Fletcher et al. | 414/208 |
| 2014/0110891 | A1* | 4/2014 | Aichinger | C21B 13/002 266/44 |

FOREIGN PATENT DOCUMENTS

| | | |
|---|---|---|
| EP | 1 662 009 A1 | 5/2006 |
| RU | 2 165 84 | 4/2001 |
| SU | 1591815 | 9/1990 |
| WO | 97/47774 A1 | 12/1997 |
| WO | 97/48825 A1 | 12/1997 |

OTHER PUBLICATIONS

English Abstract for Japanese Patent Publication 2002256311 A published Sep. 11, 2002.

International Search Report for PCT/EP2012/058499; mailed Aug. 17, 2012.

Russian Decision of Grant dated Mar. 29, 2016 from Russian Patent Application No. 2013156411/02 (087925), 17 pages, with German translation.

* cited by examiner

METHOD AND DEVICE FOR CHARGING COAL-CONTAINING MATERIAL AND IRON CARRIER MATERIAL

CROSS REFERENCE TO RELATED APPLICATIONS

This application is the U.S. national stage of International Application No. PCT/EP2012/058499, filed, May 9, 2012 and claims the benefit thereof. The International Application claims the benefits of Austrian Application No. A723/2,011 filed on May 19, 2011, both applications are incorporated by reference herein in their entirety.

BACKGROUND

1. Technical Field

Described below is a method for charging material, including lumped carbonaceous (coal-containing) material and (e.g., hot) iron carrier material, into a melter gasifier of a smelting reduction plant.

2. Related Art

In the context of smelting reduction processes for producing pig iron in a melter gasifier, e.g. COREX® or FINEX®, material including carbonaceous material, iron carrier material and fluxes is charged into the melter gasifier. The carbonaceous material is gasified with oxygen to produce a reduction gas, the heat required to melt the iron carrier material being released in the process.

Carbonaceous material includes e.g. coal in lump form or carbonaceous briquettes. It is stored at ambient temperature in a charging bin for carbonaceous material, from which it is loaded into the melter gasifier. In the case of FINEX®, for example, the iron carrier material is hot-briquetted iron (HBI) or hot-compacted iron (HCI). HBI is hot-compacted iron having a very high proportion of metallic iron (often more than 90% metallization) and a density of approximately 5 g/cm$^3$, allowing transport by ship, for example. The material takes the form of individual briquettes, generally >25 mm, and is therefore present in lump form. HCI is hot-compacted iron with fluxes and has a lower proportion of metallic iron than HBI. Its density is slightly less than 4 g/cm$^3$. As part of the manufacturing process for pig iron, HCI is further processed immediately after production, being granulated by crushers and used in a form that is advantageous for a melter gasifier. HCI has a temperature of approximately 550-650° C. in this case. In the case of COREX®, the iron carrier material is e.g. hot direct reduced iron (DRI).

Pyrolysis of coal or carbonaceous briquettes at high temperatures results in the development and release of volatile hydrocarbons and tar. Therefore the carbonaceous material cannot be stored together with hot iron carrier material in a charging bin, since the development and release of volatile hydrocarbons and tar, triggered by the contact with the hot iron carrier material, would result in conglutination and blockages in the charging bin and in the lines transporting the material to the melter gasifier.

The charging of carbonaceous material and iron carrier material into a melter gasifier usually takes place separately in existing related art installations.

Carbonaceous material is transported from e.g. a charging bin for carbonaceous material via screw feeders to a distributing device which is disposed centrally in the dome of the melter gasifier and from which the carbonaceous material is distributed over the cross-section of the melter gasifier as it is introduced into the melter gasifier. Iron carrier material is introduced into the melter gasifier e.g. via a plurality of drop shafts which are arranged around the circumference of the dome of the melter gasifier.

The separate addition of carbonaceous material and iron carrier material into the melter gasifier involves considerable expense in terms of the construction and maintenance of those plant parts required for the separate addition. Moreover, in the case of separate addition, the carbonaceous material and iron carrier material are not distributed with an adequate degree of control on the material bed in the melter gasifier, and e.g. the formation of vertical islands of iron carrier material can occur, thereby adversely affecting the melting and gasification process.

It is known from EP0,299,231A1 to charge the carbonaceous material and the iron carrier material into the melter gasifier centrally via the same opening. Central charging as described in EP0,299,231A1 is disadvantageous in that fresh material is supplied to precisely that region of the material bed which is known as the "dead man" region in the melting and gasification process, wherein preheating and reduction processes take place less effectively than in the peripheral region of the melter gasifier. Moreover, fine and heavy material remains concentrated in the central region of the material bed due to segregation processes, while coarser and lighter material migrates toward the peripheral region. Accordingly, the mixture which is charged onto the material bed is again segregated to some extent and in an uncontrolled manner.

SUMMARY

The method and device are for charging material which includes carbonaceous material and (e.g., hot) iron carrier material, the method and device, in comparison with the related art, not only being associated with less construction and maintenance overhead but also enabling controlled distribution.

Technical Solution

This is achieved by a method for charging material, including lumped carbonaceous material and (e.g., hot) iron carrier material, into a melter gasifier of a smelting reduction plant, wherein the lumped carbonaceous material and the (e.g., hot) iron carrier material are combined before and/or during entry into the melter gasifier, and the ratio of the combined quantities of (e.g., hot) iron carrier material and lumped carbonaceous material can be varied, wherein the combined quantities of (e.g., hot) iron carrier material and lumped carbonaceous material are distributed over the cross-section of the melter gasifier by a dynamic distributing device, and the ratio of the combined quantities of (e.g., hot) iron carrier material and lumped carbonaceous material is set as a function of the position of the dynamic distributing device.

Advantageous Effects

Using such a method, the melter gasifier requires fewer plant parts and openings for charging than when lumped carbonaceous material and iron carrier material enter the melter gasifier separately.

Hot iron carrier material is understood to mean iron carrier material having a temperature higher than 100° C., e.g., higher than 200° C., such as higher than 300° C. The iron carrier material contains elementary iron and/or iron oxide. The iron carrier material is present in lump form, in lump form with a proportion of fines, or as fine grain (such as less than 10 mm).

The carbonaceous material is present in lump form. The proportion of coal in the lumped carbonaceous material represents at least 50% by weight, e.g., at least 70% by weight, such as 90% by weight. In this case the proportion by weight relates to the weight of the constituents of the lumped carbonaceous material at the time when the constituents are loaded into the charging bin. In addition to coal, the lumped carbonaceous material may also contain coke, for example.

No further details of the fluxes such as limestone and/or dolomite and/or quartz, for example, which are also charged into the melter gasifier (which may be via the iron carrier route) in the context of a method, are included within the scope of the present application.

The lumped carbonaceous material and the (e.g., hot) iron carrier material may be combined shortly before and/or during entry of the mixture, which is obtained by the combination, into the melter gasifier. In this case, lumped carbonaceous material and the (e.g., hot) iron carrier material are merged during transport to the melter gasifier, e.g. in a chute, without previously being stored together in a bunker, in order to ensure that the time during which the two materials are present together in parts of the plant outside of the melter gasifier is restricted, for example, to less than a few seconds, e.g., up to 10 seconds. This reduces the risk that pyrolysis of the lumped carbonaceous material, triggered by contact with hot iron carrier material, will result in conglutination and blockages of the mixture, which is obtained by combination, in the plant parts leading to the melter gasifier.

The pyrolysis and gasification of the lumped carbonaceous material therefore first occurs in the melter gasifier.

The term melter gasifier does not include a blast furnace. In a blast furnace, layers of coke and iron carrier with fluxes are essentially added from above under environmental conditions. Pyrolysis and degasification of coal does not take place in the blast furnace, but beforehand during the production of the coke which is charged into the blast furnace. The temperatures at the top of a blast furnace range from approximately 80 to 250° C. In the case of a melting and gasification process in a melter gasifier, in contrast, not coke but carbonaceous material is charged, and the charged carbonaceous material is pyrolized in the melter gasifier. The temperatures prevailing in the melter gasifier dome are approximately 1000° C. in the region where material is charged into the melter gasifier.

As a result of charging lumped carbonaceous material and (e.g., hot) iron carrier material together, it is possible to avoid the problem of uncontrolled and unwanted inhomogeneous distribution which occurs when they are charged separately, e.g., forming vertical islands of iron carrier material in the melter gasifier. This also eliminates the expense associated with construction and maintenance of the plant parts that are required for separate charging.

A dynamic distributing device is understood to be a distributing device which can be moved in a controlled manner during the distribution process. An outlet opening of the dynamic distributing device can therefore be moved to various positions. Accordingly, the combined quantities of (e.g., hot) iron carrier material and lumped carbonaceous material can be directed to various locations of the material bed in the melter gasifier.

The dynamic distributing device can be a rotating chute or a gimbal-mounted chute, for example, which can be moved such that its outlet opening describes circular, spiral or freely definable paths, for example, it being also possible to select different distribution tracks. The movement pattern of the dynamic distributing device can advantageously be varied.

The charged material forms a material bed in the melter gasifier. The combined quantities of (e.g., hot) iron carrier material and lumped carbonaceous material are distributed by a dynamic distributing device over the cross-section of the melter gasifier, and the ratio of the combined quantities of (e.g., hot) iron carrier material and lumped carbonaceous material is set as a function of the position of the dynamic distributing device. By virtue of the position of the dynamic distributing device in the melter gasifier defining the region in which the material to be distributed strikes the material bed in the melter gasifier, the distribution of (e.g., hot) iron carrier material and lumped carbonaceous material on the material bed of the melter gasifier can be controlled and set according to the requirements of the melting and gasification process. Specific distribution patterns of (e.g., hot) iron carrier material and lumped carbonaceous material can therefore be set in the melter gasifier. For example, a dead man of mainly carbonaceous material can be selectively developed during phased charging of carbonaceous material with little iron carrier material in the melter gasifier. The setting of specific distribution patterns of iron carrier material and carbonaceous material in the melter gasifier allows better control of the processes that take place in the melter gasifier when converting iron carrier material and carbonaceous material. This results in greater operational stability and improved process yield.

For the purpose of the melting and gasification process, the region in which it is particularly beneficial to charge material onto the material bed in the melter gasifier can be derived from the properties of the surface. In this case, the surface of the material bed is also understood to mean the top layer of the material bed, viewed in a vertical direction. The top layer is understood to be a layer having a layer thickness of up to 20 cm.

According to an embodiment of the method, the ratio of the combined quantities of (e.g., hot) iron carrier material and lumped carbonaceous material is set as a function of properties of the surface of the material bed.

According to an embodiment of the method, the property of the surface of the material bed is the height level and/or the height profile of the material bed.

According to a further embodiment of the method, the property of the surface of the material bed is the temperature profile at the surface of the material bed.

Pig iron and slag are run off from a melter gasifier at approximately regular intervals during the day, in order to prevent the liquid level in the melter gasifier from rising above the level of the nozzles for the oxygen supply. Inhomogeneous gasification and reduction ratios continuously arise during operation as a result of the running off. Negative effects of such inhomogeneities on the smelting reduction process can be counteracted by selectively charging to relevant regions within the overall area. Correspondingly, an embodiment of the method provides for the ratio of the combined quantities of (e.g., hot) iron carrier material and lumped carbonaceous material to be set as a function of the run-off sequence that is followed during the operation of the melter gasifier.

Not only the ratio of the combined quantities of (e.g., hot) iron carrier material and lumped carbonaceous material, but also the grain size distribution and the types of materials have an effect on the melting and gasification process. With regard to the lumped carbonaceous material, grain size distribution in this case is understood to be the lump size of the lumped carbonaceous material. Various types of (e.g., hot) iron carrier material have different proportions of metallic iron and iron oxide or other constituents, for example. Various types of lumped carbonaceous material have different proportions of coke or other constituents, for example. Various types of (e.g., hot) iron carrier material and lumped carbonaceous material are dependent on the source from which they are obtained, for example. According to an embodiment of the method, the grain size distribution of the (e.g., hot) iron carrier material and/or the lump size of the lumped carbonaceous material are selected as a function of the position of the dynamic distributing device. According to a further embodiment of the method, the type of charged (e.g., hot) iron carrier material and/or the type of lumped carbonaceous material are selected as a function of the position of the dynamic distributing device.

The subject matter of the present application also relates to a device for charging material, including lumped carbonaceous material and (e.g., hot) iron carrier material, into a melter gasifier of a smelting reduction plant, having at least one charging bin for lumped carbonaceous material, and having at least one charging bin for (e.g., hot) iron carrier material, wherein a first discharge line for lumped carbonaceous material emerges from the at least one charging bin for lumped carbonaceous material and includes a first conveyor device for regulating the discharge of lumped carbonaceous material, and wherein a second discharge line for (e.g., hot) iron carrier material emerges from the at least one charging bin for (e.g., hot) iron carrier material and includes a second conveyor device for regulating the discharge of (e.g., hot) iron carrier material, and having an input device for inputting material into the melter gasifier wherein the first discharge line for lumped carbonaceous material and the second discharge line for (e.g., hot) iron carrier material open into the input device for inputting material into the melter gasifier, wherein the input device for inputting material into the melter gasifier includes a dynamic distributing device for distributing the material during the input, and a device is provided for controlling at least one of the conveyor devices from the group

- first conveyor device for regulating the discharge of lumped carbonaceous material
- second conveyor device for regulating the discharge of (e.g., hot) iron carrier material as a function of the position of the dynamic distributing device.

The method can be performed using such a device. Carbonaceous material and (e.g., hot) iron carrier material can be combined before and/or during entry into the melter gasifier.

The input device for inputting material into the melter gasifier can include screw feeders, for example.

A device of the type can be operated in such a way that lumped carbonaceous material and (e.g., hot) iron carrier material are continuously combined. It can also be operated in such a way that iron carrier material, e.g., hot iron carrier material, is intermittently added to a continuous stream of carbonaceous material. It can also be operated such that lumped carbonaceous material is intermittently added to a continuous stream of iron carrier material, e.g., hot iron carrier material. It can also be operated in such a way that a stream of lumped carbonaceous material and a stream of (e.g., hot) iron carrier material are input alternately into the melter gasifier via the input device for inputting material.

The input device for inputting material into the melter gasifier includes a dynamic distributing device for distributing the material during the input. A distribution of the material over the horizontal cross-section of the interior of the melter gasifier is meant in this case. Specific distribution patterns of (e.g., hot) iron carrier material and lumped carbonaceous material can therefore be set in the melter gasifier. The input device for inputting material into the melter gasifier and including a dynamic distributing device can be a gimbal-mounted chute, such as driven via two axes, or a rotating chute, for example.

According to an embodiment of the device, two charging bins for (e.g., hot) iron carrier material and/or two charging bins for lumped carbonaceous material are provided. It is thereby possible to ensure more uniform charging, because a second, full charging bin can be used when the first charging bin is completely empty. While the second charging bin is being emptied, the first charging bin can then be replenished such that it is available for the charging again when the second charging bin is completely empty. Moreover, it is thereby possible to charge different types of (e.g., hot) iron carrier material and/or different types of lumped carbonaceous material, or to charge different grain sizes of (e.g., hot) iron carrier material and/or different lump sizes of lumped carbonaceous material, if the two charging bins are filled accordingly. It is also possible to provide more than two charging bins for iron carrier material, e.g., hot iron carrier material, and/or more than two charging bins for lumped carbonaceous material.

According to an embodiment of the device, the first conveyor device for regulating the discharge of lumped carbonaceous material and/or the second conveyor device for regulating the discharge of (e.g., hot) iron carrier material may include one or more material flow gates.

According to an embodiment of the device, the first conveyor device for regulating the discharge of lumped carbonaceous material and/or the second conveyor device for regulating the discharge of (e.g., hot) iron carrier material may include one or more screw feeders. Screw feeders allow more effective regulation of quantities than material flow gates and the material can be transported horizontally, wherein a plurality of charging bins can be arranged next to one another and the materials can be conveyed to the shared input device and thence to the melter gasifier.

According to an embodiment of the device, the first conveyor device for regulating the discharge of lumped carbonaceous material and/or the second conveyor device for regulating the discharge of (e.g., hot) iron carrier material may include one or more cellular wheel sluices. Cellular wheel sluices allow more effective regulation of quantities than material flow gates and, in comparison with screw feeders, can minimize an undesirable gas flow via the cellular wheel sluice if there is a pressure difference.

Hybrid forms are also possible, e.g. a device in which a screw feeder is provided for regulating the discharge of lumped carbonaceous material in the first discharge line, and a material flow gate is provided for regulating the discharge of (e.g., hot) iron carrier material in the second discharge line. Such a hybrid form is advantageous if it is necessary to generate a continuous stream of lumped carbonaceous material, for example.

According to an embodiment, a device is provided for regulating the distribution track which is realized during the input by the dynamic distributing device for the purpose of distributing the material. The dynamic distributing device has an outlet opening from which the material exits the dynamic distributing device. The distribution track is understood to be the track, as projected onto a horizontal plane, which is left on this plane by the outlet opening during charging. Specific distribution patterns of (e.g., hot) iron carrier material and lumped carbonaceous material can be set in the melter gasifier by varying the distribution track over the horizontal cross-section of the interior of the melter gasifier.

According to another embodiment, a device is provided for controlling the first conveyor device for regulating the discharge of lumped carbonaceous material, and/or the second conveyor device for regulating the discharge of (e.g., hot) iron carrier material, as a function of the distribution track which is realized during the input by the dynamic distributing device for the purpose of distributing the material. It is therefore possible to set a specific distribution pattern of (e.g., hot) iron carrier material and carbonaceous material in the melter gasifier. This device is used to control the material flow gates and/or the screw feeders, for example.

At least one device is advantageously provided for capturing properties of the surface of the material bed that has formed in the melter gasifier. Such a device may be e.g. a microwave measuring device or a radar measuring device for determining height and/or profile and/or temperature and/or the composition of the gas escaping from the material bed, or a thermometer for determining the temperature or the temperature profile at the surface of the material bed. A plurality of such devices may also be present.

Accordingly, a device is provided for controlling the first conveyor device for regulating the discharge of lumped carbonaceous material, and/or the second conveyor device for regulating the discharge of (e.g., hot) iron carrier material, as a function of the properties which have been captured by the device for capturing properties of the surface of the material bed that has formed in the melter gasifier. In this way the ratio of the combined quantities of (e.g., hot) iron carrier material and lumped carbonaceous material can be set as a function of properties of the surface of the material bed.

According to an embodiment of the device, provision is made for at least two charging bins for lumped carbonaceous material, these being filled with lumped carbonaceous material of different lump sizes. For example, a first charging bin for lumped carbonaceous material is filled with a lump size A, and a second charging bin for lumped carbonaceous material is filled with a lump size B, where the lump sizes A and B are different. If applicable, a third charging bin for lumped carbonaceous material may be present and filled with a lump size C, where the lump size C is different from the lump sizes A and B.

According to an embodiment of the device, provision is made for at least two charging bins for lumped carbonaceous material, these being filled with different types of lumped carbonaceous material. For example, a first charging bin for lumped carbonaceous material is filled with a type A, and a second charging bin for lumped carbonaceous material is filled with a type B, where the types A and B are different. If applicable, a third charging bin for lumped carbonaceous material may be present and filled with a type C, where the type C is different from the types A and B.

According to an embodiment of the device, provision is made for at least two charging bins for (e.g., hot) iron carrier material, these being filled with iron carrier material, e.g., hot iron carrier material, of different grain sizes. For example, a first charging bin for (e.g., hot) iron carrier material is filled with a grain size A, and a second charging bin for (e.g., hot) iron carrier material is filled with a grain size B, where the grain sizes A and B are different. If applicable, a third charging bin for (e.g., hot) iron carrier material may be present and filled with a grain size C, where the grain size C is different from the grain sizes A and B.

According to an embodiment of the device, provision is made for at least two charging bins for (e.g., hot) iron carrier material, these being filled with different types of (e.g., hot) iron carrier material. For example, a first charging bin for (e.g., hot) iron carrier material is filled with a type A, and a second charging bin for (e.g., hot) iron carrier material is filled with a type B, where the types A and B are different. If applicable, a third charging bin for (e.g., hot) iron carrier material may be present and filled with a type C, where the type C is different from the types A and B.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
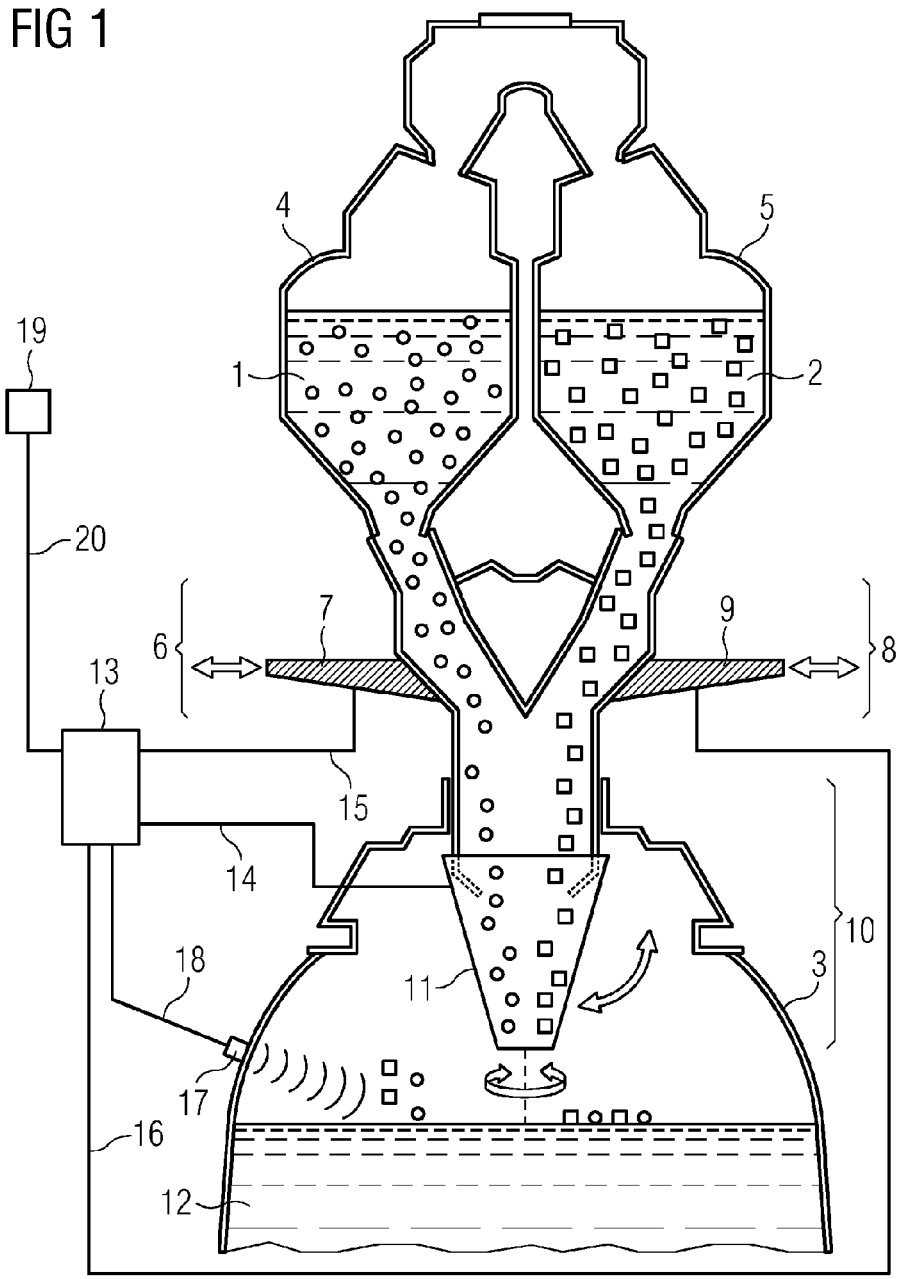
FIG. 1 is a schematic cross section of an embodiment of the device having material flow gates.

Reference will now be made in detail to the preferred embodiments, examples of which are illustrated in the accompanying drawings, wherein like reference numerals refer to like elements throughout.

FIG. 1 shows a device for charging material, including lumped carbonaceous material 1, this being represented by circles, and hot iron carrier material 2, this being represented by squares, into a melter gasifier 3 of a smelting reduction plant. The device has a charging bin 4 for lumped carbonaceous material and a charging bin 5 for hot iron carrier material. A first discharge line 6 for lumped carbonaceous material emerges from the charging bin 4 for lumped carbonaceous material, the first discharge line including a first conveyor device 7 for regulating the discharge of lumped carbonaceous material 1. A second discharge line 8 for hot iron carrier material emerges from the charging bin 5 for hot iron carrier material, the second discharge line including a second conveyor device 9 for regulating the discharge of hot iron carrier material 2. The first conveyor device 7 for regulating the discharge of lumped carbonaceous material 1 and the second conveyor device 9 for regulating the discharge of hot iron carrier material 2 are embodied as material flow gates. These material flow gates can be moved, as indicated by straight dual-headed arrows. FIG. 1 illustrates the material flow gates in a position at which they do not restrict the first discharge line 6 for lumped carbonaceous material and/or the second discharge line 8 for hot iron carrier material. The illustration of a position at which they are partially pushed in, and therefore restrict the first discharge line 6 for lumped carbonaceous material or, as the case may be, the second discharge line 8 for hot iron carrier material, has been omitted for the clarity of illustration reasons. The lumped carbonaceous material 1 and the hot iron carrier material 2 are combined before they enter the melter gasifier 3. For this purpose the first discharge line 6 for lumped carbonaceous material and the second discharge line 8 for hot iron carrier material open into an input device 10 for inputting material into the melter gasifier 3.

Lumped carbonaceous material 1 and hot iron carrier material 2 are input into the melter gasifier via the input device 10 for inputting material into the melter gasifier. The input device 10 for inputting material into the melter gasifier 3 includes a dynamic distributing device 11 for distributing the material during the input, this being a gimbal-mounted chute in the illustrated case. The possible rotation of the gimbal-mounted chute is indicated by a curved dual-headed arrow which embraces the rotational axis of the rotational movement indicated by a dashed line. The pivoting movement of the gimbal-mounted chute is indicated by a curved dual-headed arrow. Lumped carbonaceous material 1 and hot iron carrier material 2 are distributed on the material bed 12 in the melter gasifier 3 in a controlled manner by the gimbal-mounted chute.

The ratio of the combined quantities of hot iron carrier material 2 and lumped carbonaceous material 1 can be varied. For this purpose a control device 13 is used to control at least one of the conveyor devices from the group first conveyor device 7 for regulating the discharge of lumped carbonaceous material second conveyor device 9 for regulating the discharge of hot iron carrier material as a function of the position of the dynamic distributing device 10. Toward that end, the control device 13 is connected to the dynamic distributing device 11 via the signal line 14 for the purpose of transmitting information relating to the position of the dynamic distributing device 11.

For example, it is possible to determine the current position of the gimbal-mounted chute in relation to the circular arc that is described by the movement of the gimbal-mounted chute. The first conveyor device 7, embodied in the form of a material flow gate, for regulating the discharge of lumped carbonaceous material 1 is controlled, via the signal line 15, as a function of the position of the dynamic distributing device 10.

The second conveyor device 9, embodied in the form of a material flow gate, for regulating the discharge of hot iron carrier material 2 is controlled, via the signal line 16, as a function of the position of the dynamic distributing device 10.

Also provided is a device 17 for capturing properties of the surface of the material bed that has formed in the melter gasifier, the device taking the form of a radar measuring device with integrated temperature measuring device in the illustrated case. The radar measuring device collects information relating to height level and height profile of the material bed 12 in the melter gasifier 3. The temperature measuring device collects information relating to the temperature profile at the surface of the material bed. The information relating to properties of the surface of the material bed that has formed in the melter gasifier is transmitted via the signal line 18 to the control device 13 for the first conveyor device for regulating the discharge of lumped carbonaceous material and/or the second conveyor device, where it is used to regulate the discharge of hot iron carrier material as a function of the captured properties.

In this way the ratio of the combined quantities of hot iron carrier material 2 and lumped carbonaceous material 1 can be set as a function of properties of the surface of the material bed.

Information relating to the run-off sequence that is followed during the operation of the melter gasifier can be transmitted to the control device 13 for the first conveyor device for regulating the discharge of lumped carbonaceous material and/or the second conveyor device by an information input device 19 which is connected for data transmission purposes via the signal line 20 to the control device 13 for the first conveyor device for regulating the discharge of lumped carbonaceous material and/or the second conveyor device. The ratio of the combined quantities of hot iron carrier material and lumped carbonaceous material can therefore be set as a function of the run-off sequence that is followed during the operation of the melter gasifier. The cited signal lines may be provided physically in the form of cables, although the possibility of wireless signal transmission is also included.

Figure 2:
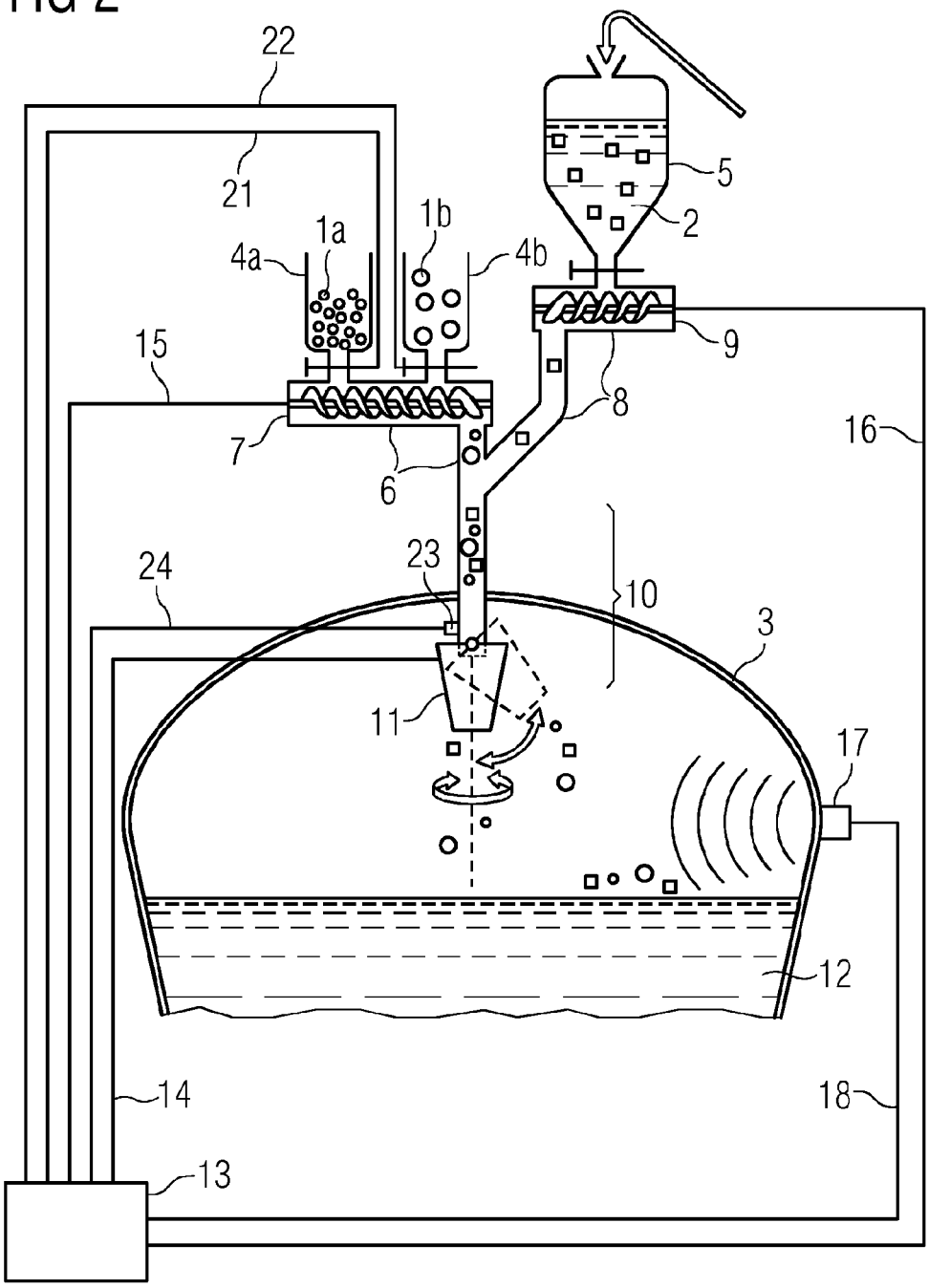
FIG. 2 is a schematic cross section of an embodiment of the device having screw feeders.

FIG. 2 shows a device for charging material, including lumped carbonaceous material 1, this being represented by circles, and hot iron carrier material 2, this being represented by squares, into a melter gasifier 3 of a smelting reduction plant. The device has two charging bins for lumped carbonaceous material, one charging bin 4*a* for lumped carbonaceous material and one charging bin 4*b* for lumped carbonaceous material. Lumped carbonaceous material 1*a* having a lump size A is stored in the charging bin 4*a* for lumped carbonaceous material, while lumped carbonaceous material 1*a* having a lump size B is stored in the charging bin 4*b* for lumped carbonaceous material. The lump sizes A and B are different, this being represented by circles of different sizes. The device for charging material also has a charging bin 5 for hot iron carrier material. A first discharge line 6 for lumped carbonaceous material emerges from the two charging bins 4*a*/4*b* for lumped carbonaceous material, the first discharge line including a first conveyor device 7 for regulating the discharge of lumped carbonaceous material 1. A second discharge line 8 for hot iron carrier material emerges from the charging bin 5 for hot iron carrier material, the second discharge line a second conveyor device 9 for regulating the discharge of hot iron carrier material 2. The first conveyor device 7 for regulating the discharge of lumped carbonaceous material 1 and the second conveyor device 9 for regulating the discharge of hot iron carrier material 2 are embodied as screw feeders.

The lumped carbonaceous material 1*a*/1*b* and the hot iron carrier material 2 are combined before they enter the melter gasifier 3. For this purpose the first discharge line 6 for lumped carbonaceous material and the second discharge line 8 for hot iron carrier material open into an input device 10 for inputting material into the melter gasifier 3.

Lumped carbonaceous material 1*a*/1*b* and hot iron carrier material 2 are input into the melter gasifier 3 via the input device 10 for inputting material into the melter gasifier. The input device 10 for inputting material into the melter gasifier 3 includes a dynamic distributing device 11 for distributing the material during the input, this being a gimbal-mounted chute in the illustrated case. For clarity of illustration reasons, details of the gimbal mounting are not shown. The gimbal-mounted chute can be rotated about a rotational axis and adjusted in its inclination. The possible rotation of the gimbal-mounted chute is indicated by a curved dual-headed arrow which embraces the rotational axis of the rotational movement indicated by a dashed line. The adjustability of the inclination is indicated such that the outline of the gimbal-mounted chute is represented as a continuous line for one position and as a broken line for another position. The adjustability of the inclination is also indicated by a curved dual-headed arrow. Lumped carbonaceous material 1*a*/1*b* and hot iron carrier material 2 are distributed on the material bed 12 in the melter gasifier 3 in a controlled manner by the gimbal-mounted chute. The movement pattern of the gimbal-mounted chute can be varied, describing e.g. circular or elliptical paths by different inclinations and therefore different resulting distributions on the material bed 12.

As illustrated analogously in FIG. 1 above, the ratio of the combined quantities of hot iron carrier material 2 and lumped carbonaceous material 1*a*/1*b* can be varied. For this purpose a control device 13 is used to control at least one of the conveyor devices from the group first conveyor device 7 for regulating the discharge of lumped carbonaceous material second conveyor device 9 for regulating the discharge of hot iron carrier material as a function of the position of the dynamic distributing device 10. Toward that end, the control device 13 is connected to the dynamic distributing device 11 via the signal line 14 for the purpose of transmitting information relating to the position of the dynamic distributing device 11.

For example, it is possible to determine the current position of the gimbal-mounted chute in relation to its path of rotation, and its current inclination. The first conveyor device 7, embodied in the form of a screw feeder, for regulating the discharge of lumped carbonaceous material 1*a*/1*b* is controlled, via the signal line 15, as a function of the position of the dynamic distributing device 10. The discharge can be regulated by changing the rotational speed of the screw feeder, for example.

The second conveyor device 9, embodied in the form of a screw feeder, for regulating the discharge of hot iron carrier material is controlled, via the signal line 16, as a function of the position of the dynamic distributing device 10.

Also provided is a device 17 for capturing properties of the surface of the material bed that has formed in the melter gasifier, the device taking the form of a radar measuring device with integrated temperature measuring device in the illustrated case. The radar measuring device collects information relating to height level and height profile of the material bed 12 in the melter gasifier 3. The temperature measuring device collects information relating to the temperature profile at the surface of the material bed. The information relating to properties of the surface of the material bed that has formed in the melter gasifier is transmitted via the signal line 18 to the control device 13 for the first conveyor device for regulating the discharge of lumped carbonaceous material and/or the second conveyor device, where it is used to regulate the discharge of hot iron carrier material as a function of the captured properties. In this way the ratio of the combined quantities of hot iron carrier material 2 and lumped carbonaceous material 1 can be set as a function of properties of the surface of the material bed. The opening mechanism of the charging bin 4*a* for lumped carbonaceous material can be activated by the control device 13 via the signal line 21, and the opening mechanism of the charging bin 4*b* for lumped carbonaceous material can be activated by the control device 13 via the signal line 22. This activation allows the lump size of the lumped carbonaceous material to be selected as a function of the position of the dynamic distributing device. The opening mechanism of the charging bin 5 for hot iron carrier material can also be activated by the control device 13, though for clarity of illustration reasons this is not shown here. The cited signal lines may be provided physically in the form of cables, although the possibility of wireless signal transmission is also included.

In a similar manner to the illustrated possibility of selecting the lump size of the lumped carbonaceous material as a function of the position of the dynamic distributing device, the type of lumped carbonaceous material can be selected as a function of the position of the dynamic distributing device if lumped carbonaceous materials 1*a* and 1*b* are of different types.

If provision is similarly made for two charging bins 5 for hot iron carrier material, these being filled with hot iron carrier material of a different grain size distribution and/or different type in each case, the grain size distribution and/or the type of the hot iron carrier material can be selected as a function of the position of the dynamic distributing device in a similar manner to the lumped carbonaceous material.

A device 23 is provided for regulating the distribution track which is realized during the input by the dynamic distributing device for distributing the material. This is illustrated schematically and works by influencing the drive mechanism of the dynamic distributing device 11 or by influencing those plant parts which are responsible for the inclination of the distributing device 11.

By varying the distribution track over the horizontal cross-section of the interior of the melter gasifier, it is possible to set specific distribution patterns of hot iron carrier material and lumped carbonaceous material in the melter gasifier. The device 23 for regulating the distribution track which is realized during the input by the dynamic distributing device for distributing the material is connected via the signal line 24 to the control device 13 for controlling at least one of the conveyor devices from the group first conveyor device for regulating the discharge of lumped carbonaceous material second conveyor device for regulating the discharge of hot iron carrier material as a function of the position of the dynamic distributing device.

Since the realized distribution track is determined by the position of the dynamic distributing device, the control device 13 also constitutes a device for controlling the first conveyor device for regulating the discharge of lumped carbonaceous material, and/or the second conveyor device for regulating the discharge of hot iron carrier material, as a function of the distribution track 23 which is realized during the input by the dynamic distributing device for distributing the material. A specific distribution pattern of hot iron carrier material and carbonaceous material can therefore be set in the melter gasifier. This device can be used to control the material flow gates and/or the screw feeders, for example.

Although the invention has been illustrated and described in detail with reference to the exemplary embodiments, the invention is not restricted by the examples disclosed herein, and other variations may be derived herefrom by a person skilled in the art without thereby departing from the spirit and scope of protection of the claims which may include the phrase "at least one of A, B and C" as an alternative expression that means one or more of A, B and C may be used, contrary to the holding in Superguide v. DIRECTV, 358 F3d 870, 69 USPQ2d 1865 (Fed. Cir. 2004).

The invention claimed is:

1. A method for charging material, comprising lumped carbonaceous material and iron carrier material, into a melter gasifier of a smelting reduction plant, the method comprising:

combining the lumped carbonaceous material and the iron carrier material before and/or during entry into the melter gasifier in a ratio of combined quantities of iron carrier material and lumped carbonaceous material, with variability in the ratio controlled by a control device; and distributing the combined quantities of iron carrier material and lumped carbonaceous material, in the ratio of the combined quantities of iron carrier material and lumped carbonaceous material, over a cross-section of the melter gasifier using a dynamic distributing device, thereby forming a material bed in the melter gasifier; and during the distributing, capturing at least one property of a surface of a material bed formed in the melter gasifier and setting, by the control device, the ratio of the combined quantities of iron carrier material and lumped carbonaceous material as a function of the at least one property.

2. The method as claimed in claim 1, wherein the iron carrier material is hotter than the lumped carbonaceous material when combined therewith.

3. The method as claimed in claim 1, wherein the at least one property of the surface of the material bed is at least one of a height level and a height profile of the material bed.

4. The method as claimed in claim 1, wherein the at least one property of the surface of the material bed is a temperature profile at the surface of the material bed.

5. The method as claimed in claim 4, further comprising obtaining information relating to a run-off sequence during operation of the melter gasifier, wherein the ratio of the combined quantities of iron carrier material and lumped carbonaceous material is set by the control device as a function of also the information relating to the run-off sequence during operation of the melter gasifier.

6. The method as claimed in claim 5, further comprising, during the distributing:

varying a movement pattern of the dynamic distributing device; and determining a position of the dynamic distributing device.

7. The method as claimed in claim 6, wherein at least one of a grain size distribution of the iron carrier material and a lump size of the lumped carbonaceous material is selected as a function of also the position of the dynamic distributing device.

8. The method as claimed in claim 6, wherein at least one of a type of charged iron carrier material and a type of the lumped carbonaceous material is selected as a function of also the position of the dynamic distributing device.

9. An apparatus for charging material, including lumped carbonaceous material and iron carrier material, into a melter gasifier of a smelting reduction plant, comprising:

at least one carbon charging bin for lumped carbonaceous material;

at least one iron charging bin for iron carrier material;

a first discharge line for the lumped carbonaceous material emerging from the at least one carbon charging bin, the first discharge line including a first conveyor device regulating discharge of the lumped carbonaceous material;

a second discharge line for the iron carrier material emerging from the at least one iron charging bin, the second discharge line including a second conveyor device regulating discharge of the iron carrier material;

an input device, receiving the lumped carbonaceous material and the iron carrier material from the first and second discharge lines and inputting combined material into the melter gasifier, including a dynamic distributing device distributing the material during the inputting;

at least one control device controlling the first conveyor device and/or the second conveyor device; and a capture device capturing properties of a surface of a material bed formed in the melter gasifier.

10. The apparatus as claimed in claim 9, wherein the at least one iron charging bin includes two iron charging bins for the iron carrier material, and/or the at least one carbon charging bins includes two carbon charging bins for the lumped carbonaceous material.

11. The apparatus as claimed in claim 9, wherein at least one of the first conveyor device and the second conveyor device includes material flow gates and/or screw feeders and/or cellular wheel sluices.

12. The apparatus as claimed in claim 11, further comprising a regulating device regulating a distribution track realized during the inputting by the dynamic distributing device.

13. The apparatus as claimed in claim 12, wherein the at least one control device further controls the first conveyor device and/or the second conveyor device as a function of a position of the dynamic distributing device and the distribution track.

14. The apparatus as claimed in claim 9, wherein the at least one control device further controls the first conveyor device and/or the second conveyor device as a function of the properties of the surface of the material bed captured by the capture device.

15. The apparatus as claimed in claim 14, wherein the at least one carbon charging bin includes two carbon charging bins for the lumped carbonaceous material, and the at least two carbon charging bins are filled with respectively different lump sizes of the lumped carbonaceous material and/or respectively different types of the lumped carbonaceous material.

16. The apparatus as claimed in claim 14, wherein the at least one iron charging bin includes two iron charging bins for the lumped carbonaceous material, and the at least two iron charging bins are filled with respectively different grain sizes of the iron carrier material and/or respectively different types of the iron carrier material.

17. The method as claimed in claim 1, further comprising:

during the distributing, determining a position of the dynamic distributing device, wherein in the setting, the control device sets the ratio of the combined quantities of iron carrier material and lumped carbonaceous material as a function of also the position of the dynamic distributing device.

18. The apparatus as claimed in claim 9, wherein:

the control device determines a position of the dynamic distributing device, and the control device sets the ratio of the combined quantities of iron carrier material and lumped carbonaceous material as a function of the position of the dynamic distributing device.

* * * * *